US012059104B2

(12) United States Patent
Keizers

(10) Patent No.: US 12,059,104 B2
(45) Date of Patent: Aug. 13, 2024

(54) METHOD FOR ARRANGING AN ELEMENT, SUCH AS A SHOWER BOARD OR SHOWER DRAIN, IN A FLOOR

(71) Applicant: Easy Sanitary Solutions B.V., Oldenzaal (NL)

(72) Inventor: Jurgen Hendrik Peter Joseph Keizers, Oldenzaal (NL)

(73) Assignee: Easy Sanitary Solutions B.V., Oldenzaal (NL)

( * ) Notice: Subject to any disclaimer, the term of this patent is extended or adjusted under 35 U.S.C. 154(b) by 225 days.

(21) Appl. No.: 17/610,372

(22) PCT Filed: May 14, 2020

(86) PCT No.: PCT/NL2020/050312
§ 371 (c)(1),
(2) Date: Nov. 10, 2021

(87) PCT Pub. No.: WO2020/231263
PCT Pub. Date: Nov. 19, 2020

(65) Prior Publication Data

US 2022/0218159 A1 Jul. 14, 2022

(30) Foreign Application Priority Data

May 14, 2019 (NL) ..... 2023129

(51) Int. Cl.
*A47K 3/40* (2006.01)
*A47K 3/00* (2006.01)

(52) U.S. Cl.
CPC ..... *A47K 3/405* (2013.01); *A47K 3/008* (2013.01)

(58) Field of Classification Search
CPC ..... A47K 3/008; A47K 3/40; A47K 3/405; E03F 5/0407–0409; E04F 19/062;
(Continued)

(56) References Cited

U.S. PATENT DOCUMENTS 2,239,969 A 4/1941 Morthland
5,845,347 A 12/1998 Young
(Continued)

FOREIGN PATENT DOCUMENTS

DE 202010003239 * 7/2010 ..... A47K 3/405
DE 202019001142 U1 5/2019
(Continued)

*Primary Examiner* — David P Angwin
*Assistant Examiner* — Nicholas A Ros
(74) *Attorney, Agent, or Firm* — The Webb Law Firm

(57) ABSTRACT

The invention relates to a method for arranging an element, such as a shower board or shower drain, in a floor, which method includes the steps of: providing an element which has an upper surface with at least two straight edges lying at an angle, preferably an angle of 90 degrees. The element has a strip of a flexible watertight layer standing upright from the upper surface along the corner of the two straight edges; folding the upright strip downward, wherein the folding edge is shaped adjacently of the two straight edges of the corner and wherein the strip of the flexible watertight layer hangs downward from this folding edge; and arranging the element in the floor. The upper surface of the floor lies flush with the upper surface of the element.

16 Claims, 3 Drawing Sheets

(58) Field of Classification Search
CPC ..... E04F 19/064; E04F 15/02016; E04F 15/02188; E04F 15/02011; E04F 2201/0552
USPC ..... 52/460, 464, 468
See application file for complete search history.

(56) References Cited

U.S. PATENT DOCUMENTS

| | | | | |
|---|---|---|---|---|
| 8,347,426 | B2 * | 1/2013 | Valdenaire | A47K 3/405 4/613 |
| 10,292,539 | B2 * | 5/2019 | Schindler | A47K 3/40 |
| 2019/0191932 | A1 * | 6/2019 | Costello | A47K 3/40 |

FOREIGN PATENT DOCUMENTS

| | | | | |
|---|---|---|---|---|
| EP | 2085528 | A1 | 8/2009 | |
| EP | 2248956 | A1 | 11/2010 | |
| EP | 2423395 | A1 | 2/2012 | |
| EP | 2466023 | A1 | 6/2012 | |
| EP | 2669442 | A1 | 12/2013 | |
| EP | 3150093 | A1 | 4/2017 | |
| EP | 3243970 | A1 | 11/2017 | |
| EP | 3298938 | * | 3/2018 | A47K 3/40 |
| EP | 3298938 | A1 | 3/2018 | |
| EP | 3686363 | A1 | 7/2020 | |
| GB | 2553352 | A | 3/2018 | |

* cited by examiner

METHOD FOR ARRANGING AN ELEMENT, SUCH AS A SHOWER BOARD OR SHOWER DRAIN, IN A FLOOR

CROSS-REFERENCE TO RELATED APPLICATIONS

This application is the United States national phase of International Application No. PCT/NL2020/050312 filed May 14, 2020, and claims priority to The Netherlands Patent Application No. 2023129 filed May 14, 2019, the disclosures of which are hereby incorporated by reference in their entirety.

BACKGROUND OF THE INVENTION

Field of the Invention

The invention relates to a method for arranging an element, such as a shower board or shower drain, in a floor.

Description of Related Art

When arranging an element such as a shower board or shower drain in a floor, it is further necessary to make both the floor and the connecting walls watertight by arranging flexible watertight layers on which a finishing layer, such as a tile layer, can then be arranged. It is difficult to obtain a good seal particularly in a corner of floor or element and connecting walls lying at right angles to each other, because surfaces converge from three directions.

It is known from EP 3150093 to arrange a shower board in a floor. A corner piece of a flexible watertight layer is here folded from a blank, wherein parts of the side surfaces can be folded and wherein the folded part is adhered against one of the side surfaces. This results in a thickened portion in the upright part of the corner piece, which impedes placing of wall tiles over the corner piece. The thickened portion will result in additional tile adhesive having to be used in order to compensate for the irregularity of the thickened portion.

Forming a corner piece from individual parts in order to obtain a corner piece without thickened portions will usually result in a construction that is not watertight because it is not possible to form a good seal at the position where the bottom surface and the two side surfaces converge. Providing a mastic layer at the transitions between the individual parts does not provide a reliable seal either.

Further known are corner pieces preformed from a flexible watertight layer, for instance under the brand name Schlüter Kerdi Kereck. Such preformed corner pieces can be glued in a corner of an element and walls during construction. Further widths of watertight layers can then be arranged overlapping the corner piece.

In order to obtain a reliable seal when processing such a preformed corner piece during construction an adhesive edge of at least 5 centimetres in width is required. Such a wide edge is necessary because dust and fouling on the adhesive surfaces will be difficult to prevent on a building site.

In addition, an adhesive edge of at least 5 centimetres is not always available. When a lower tray of an elongate shower drain is for instance placed against a wall of a bathroom, a connecting flange of about 2 centimetres is all that's available on the lower tray. This is because it is desirable to have the inflow opening connect to the wall tiles, which are usually about 2 centimetres thick, including an adhesive layer.

It is possible to adhere the corner piece to the element in a production environment, where dust and fouling can be prevented. In such a production environment an adhesive edge of 2 centimetres more than suffices for a reliable adhesion of the corner piece to the element.

The elements to be incorporated in the floor need however not always be arranged against a wall. The elements can also be arranged in the middle of a floor, in which case a corner piece is not needed.

This therefore results in two types of element being offered and kept in stock: an element with a corner piece pre-adhered thereto in a production environment, and an identical element, only without corner piece. In addition, the correct element must be ordered forehand, and it is no longer possible to decide on site whether or not to arrange the element against a wall.

SUMMARY OF THE INVENTION

It is now an object of the invention to reduce or even obviate the above stated drawbacks.

This object is achieved according to the invention with a method for arranging an element, such as a shower board or shower drain, in a floor, which method comprises the steps of:

- providing an element which has an upper surface with at least two straight edges lying at an angle, preferably an angle of 90 degrees, and wherein the element has a strip of a flexible watertight layer standing upright from the upper surface along the corner of the two straight edges;
- folding the upright strip downward, wherein the folding edge is shaped adjacently of the two straight edges of the corner and wherein the strip of the flexible watertight layer hangs downward from this folding edge;
- arranging the element in the floor, wherein the upper surface of the floor lies flush with the upper surface of the element.

With the method according to the invention it is possible also to use an element on which a seal for a corner is arranged for placing in the middle of a floor and at a distance from a corner of walls.

According to the invention, an element is provided, wherein a strip of a flexible watertight layer standing upright from the upper surface along the corner of the two straight edges is provided. With this upright strip the element can be placed against two walls lying at an angle identical to the angle of the straight edges. The upright strip then also provides for a reliable seal between the element and these two walls lying at an angle.

According to the invention, this strip of a flexible watertight layer is folded downward, wherein the folding edge is shaped adjacently of the two straight edges of the corner and wherein the strip of the flexible watertight layer hangs downward from this folding edge.

By folding the flexible watertight layer downward the strip no longer extends above the upper surface of the element, whereby the element can be arranged freely in a floor and at a distance from any walls.

A shower drain or drain can be incorporated in the element, but it is also possible to use the element exclusively as corner element and to have an element with a shower drain or drain incorporated therein connect to the element. In this latter case the length can be adjusted in simple manner when a shower drain is arranged between two walls. The two corner pieces are made to length and an element with integrated shower drain or drain is positioned therebetween, so that the whole bridges the distance between the two walls.

A preferred embodiment of the method according to the invention further comprises the step of arranging a watertight layer, such as a membrane covered with a non-woven material, at least over a part of the upper surface of the element and at least over a part of the upper surface of the floor.

Since in the method according to the invention the upper surface of the element lies flush with the upper surface of the floor, a seal can be applied in simple manner by means of a watertight layer, such as a membrane covered with a non-woven material. This watertight layer can be arranged in one plane in simple manner, whereby less wide adhesive edges are required on the element.

In a further embodiment of the method according to the invention the method of providing the element comprises the steps of:

providing a rectangular strip of flexible watertight material;

providing an element which has an upper surface with at least two straight edges lying at an angle, preferably an angle of 90 degrees, and wherein the element has side walls which hang downward from the at least two straight walls;

arranging the rectangular strip of flexible watertight material on the side walls, along the corner, wherein a part of the strip extends above the upper surface of the element.

In the case that the element is for instance a shower board, a seal suitable for both application in a corner against walls and application in the middle of a floor can easily be provided with this embodiment. A shower board usually consists of a watertight foam board with a thickness of between 5 and 10 centimetres. A recess for a drain or shower drain is provided in this foam board. The rectangular strip of flexible watertight material can be arranged on the side walls of the element, along the corner in simple manner. If necessary, this strip of flexible watertight material can be folded downward.

In a further preferred embodiment of the method according to the invention providing the element takes place in a production environment, while at least the step of arranging the element in the floor takes place on a building site.

It is precisely in a production environment that dust or fouling on the adhesive surfaces can be prevented, so that a layer of flexible watertight material can also be arranged in reliable manner on an adhesive edge narrower than 5 centimetres.

Such an element can then be transported from the production environment to a building site and there be arranged in a floor. It is then possible to choose on site whether to place the element in a corner or, as according to the invention, fold the upright edge downward and arrange the element in the middle of a floor, at a distance from the walls.

In another preferred embodiment of the method according to the invention the upright strip of flexible watertight material is also elastic.

Although the upright strip can also be folded downward if it is not elastic, an elastic material will be easier to fold downward.

In another embodiment of the method according to the invention, when arranging the element in the floor, the corner of the element with the downward folded strip is arranged at a distance from walls adjacent to the floor.

BRIEF DESCRIPTION OF THE DRAWINGS

These and other features of the invention are further elucidated with reference to the accompanying drawings.

DESCRIPTION OF THE INVENTION

Figure 1:
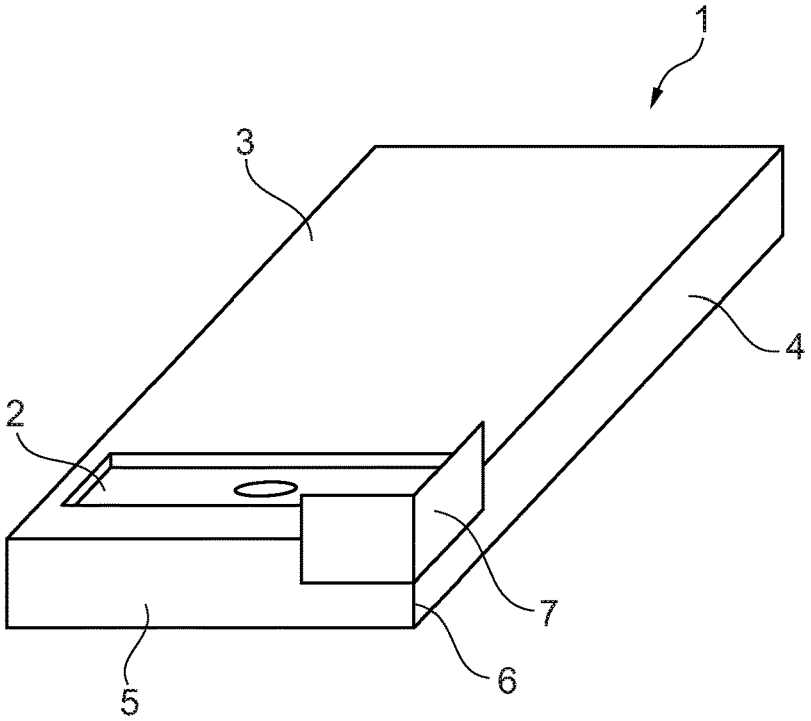
FIG. 1 shows a perspective view of an element provided according to an embodiment of the method according to the invention.

FIG. 1 shows a first step of an embodiment of the method according to the invention, in which an element, particularly a shower board 1, is provided. Shower board 1 is a watertight foam board with a recess 2 in the upper surface 3 for a shower drain. Side surfaces 4, 5 hang downward from the peripheral edge of upper surface 3.

A strip of flexible, watertight material 7 is adhered along the corner 6 of side surfaces 4, 5. This strip 7 protrudes partially above upper surface 3.

Figure 2:
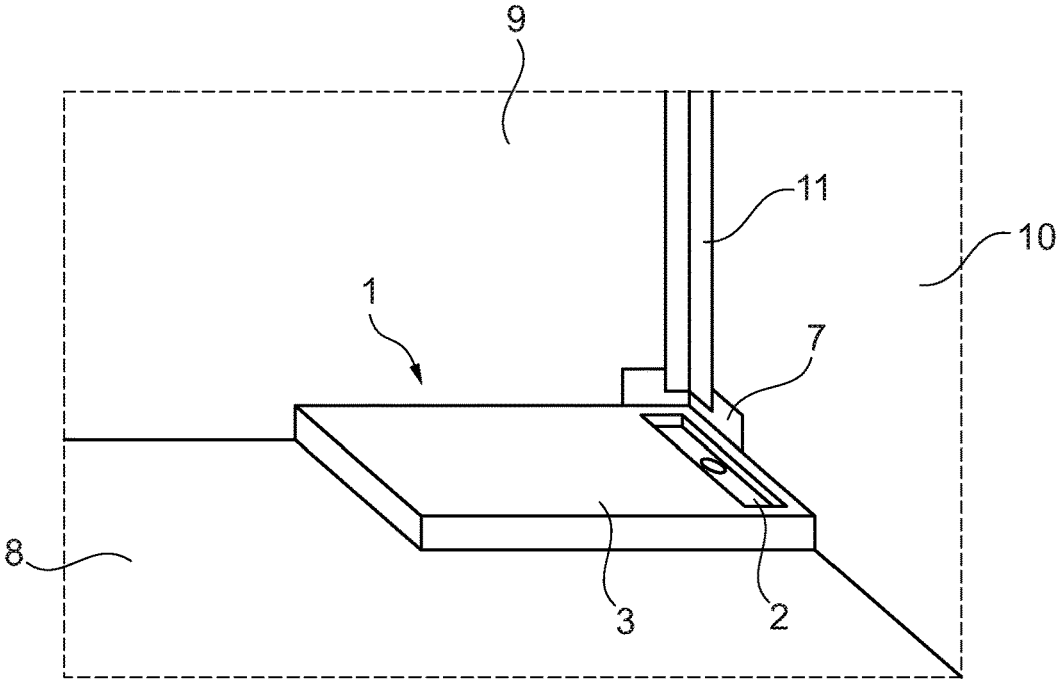
FIG. 2 shows a perspective view of the element, arranged against two walls and a floor.

FIG. 2 shows shower board 1, placed on a sub-floor 8 and against side walls 9, 10. The corner 6 of shower board 1 here lies against the corner formed by side walls 9, 10, whereby strip 7 likewise lies against side walls 9, 10. Strip 7 can be adhered to the side walls and further seals, such as champer tape 11, can be arranged partially thereover.

Figure 3:
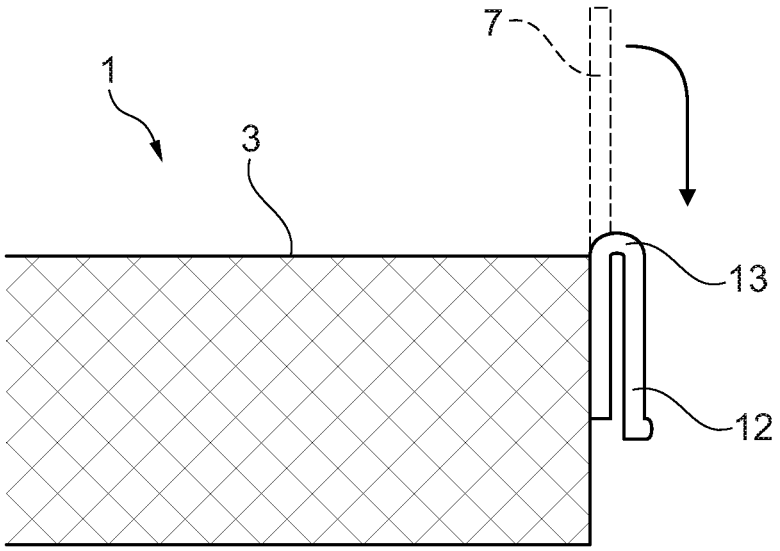
FIG. 3 shows the step of folding downward the strip of the element according to FIG. 1.

When shower board 1 need however not be arranged against side walls 9, 10 and must be arranged clear thereof in a floor, strip 7 can be folded downward, as shown in FIG. 3. The protruding part 12 of strip 7 will here be folded downward along a folding edge 13 so that strip 7 no longer protrudes above the upper surface 3 of shower board 1.

Figure 4:
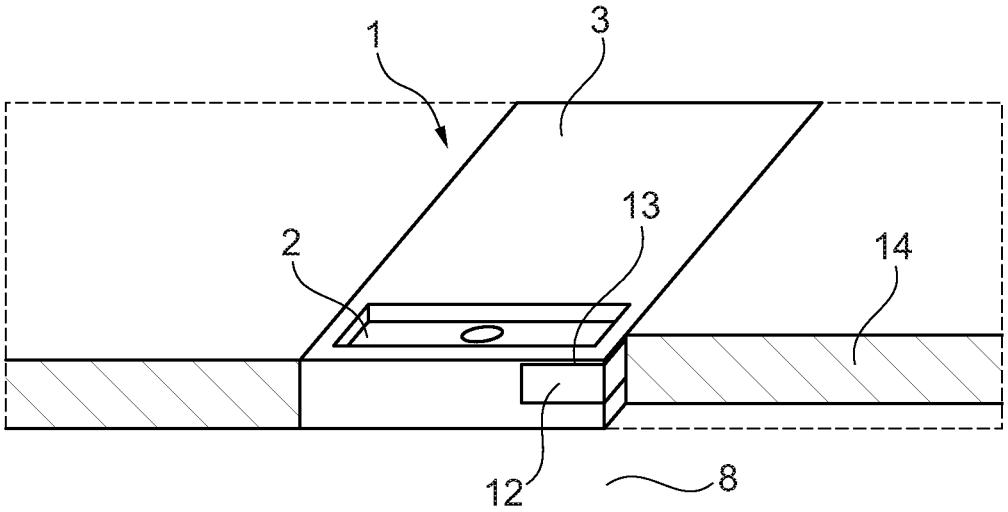
FIG. 4 shows the step of arranging the element in the floor as according to the method according to the invention.

FIG. 4 shows the step of the method wherein shower board 1 is arranged in a covering floor 14. Covering floor 14 is cast on sub-floor 8 so that shower board 1 is embedded in covering floor 14. The strip of flexible watertight material 7, 12 lies here below the level of the upper surface 3 of shower board 1.

Figure 5:
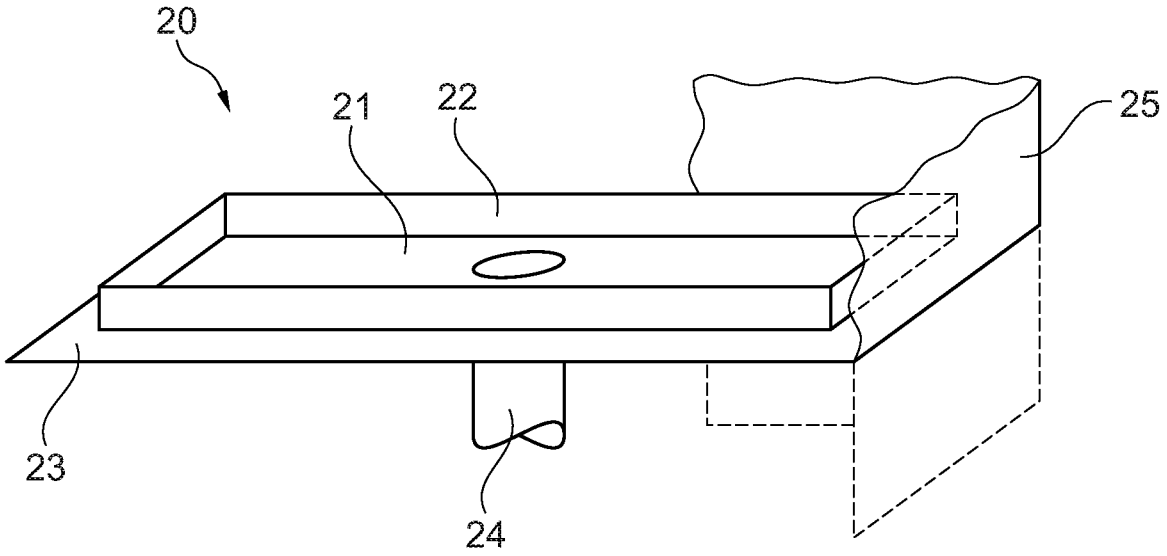
FIG. 5 shows a second embodiment of an element for the method according to the invention.

FIG. 5 shows a perspective view of a lower tray 20, which can likewise be used as element in the method according to the invention.

Lower tray 20 has a bottom 21 with a wall 22 standing upright along the edge of the bottom. A horizontal flange 23 is arranged on the outer side and a drain with outflow 24 is provided in the bottom 21.

A flexible, watertight membrane 25 is adhered to the horizontal flange 23 in a clean production environment. This membrane 25 is preformed such that it stands upright from horizontal flange 23. In this situation lower tray 20 can be arranged against a corner formed by two walls, and be properly sealed.

When lower tray 20 must however be arranged freely in the floor, membrane 25, as shown in broken lines, can be folded downward so that the membrane no longer protrudes above the upper surface formed by the upper edges of upright wall 22.

The invention claimed is:

1. A method for arranging an element in a floor, the element being a shower board or a shower drain, the method comprising the steps of:

providing the element which has an upper surface with at least two straight edges lying at an angle and which has a strip of a flexible watertight material standing upright from the upper surface along a corner of the two straight edges;

folding the upright strip downward, wherein a folding edge is shaped adjacently of the two straight edges of the corner and wherein the strip of the flexible watertight material hangs downward from this folding edge;

arranging the element in the floor, wherein an upper surface of the floor lies flush with the upper surface of the element; and arranging a watertight layer at least over a part of the upper surface of the element and at least over a part of the upper surface of the floor.

2. The method according to claim 1, wherein when arranging the element in the floor, the corner of the element with the downward folded strip is arranged at a distance from walls adjacent to the floor.

3. The method according to claim 1, wherein the angle is 90 degrees.

4. The method according to claim 1, wherein the watertight layer is a membrane covered with a non-woven material.

5. The method according to claim 1, wherein providing the element takes place in a production environment, while at least the step of arranging the element in the floor takes place on a building site.

6. The method according to claim 1, wherein the strip of flexible watertight material is also elastic.

7. The method according to claim 1, wherein the method of providing the element comprises the steps of:

providing a rectangular strip of flexible watertight material to provide the strip of flexible watertight material;

providing the element with side walls which hang downward from the at least two straight edges; and arranging the rectangular strip of flexible watertight material on the side walls, along the corner, wherein a part of the strip extends above the upper surface of the element.

8. The method according to claim 7, wherein the angle is 90 degrees.

9. A method of arranging an element in a floor, the element being a shower board or a shower drain, the method comprising the steps of:

providing the element which has an upper surface with at least two straight edges lying at an angle and which has a strip of a flexible watertight material standing upright from the upper surface along a corner of the two straight edges;

folding the upright strip downward, wherein a folding edge is shaped adjacently of the two straight edges of the corner and wherein the strip of the flexible watertight material hangs downward from this folding edge; and arranging the element in the floor, wherein an upper surface of the floor lies flush with the upper surface of the element, wherein providing the element takes place in a production environment, while at least the step of arranging the element in the floor takes place on a building site.

10. The method according to claim 9, wherein the method of providing the element comprises the steps of:

providing a rectangular strip of flexible watertight material to provide the strip with the flexible watertight layer;

providing the element with side walls which hang downward from the at least two straight edges; and arranging the rectangular strip of flexible watertight material on the side walls, along the corner, wherein a part of the strip extends above the upper surface of the element.

11. The method according to claim 9, wherein when arranging the element in the floor, the corner of the element with the downward folded strip is arranged at a distance from walls adjacent to the floor.

12. The method according to claim 9, wherein the angle is 90 degrees.

13. A method of arranging an element in a floor, the element being a shower board or a shower drain, the method comprising the steps of:

providing the element which has an upper surface with at least two straight edges lying at an angle and which has a strip of a flexible watertight material standing upright from the upper surface along a corner of the two straight edges;

folding the upright strip downward, wherein a folding edge is shaped adjacently of the two straight edges of the corner and wherein the strip of the flexible watertight material hangs downward from this folding edge; and arranging the element in the floor, wherein an upper surface of the floor lies flush with the upper surface of the element, wherein the strip of flexible watertight material is also elastic.

14. The method according to claim 13, wherein the method of providing the element comprises the steps of:

providing a rectangular strip of flexible watertight material to provide the strip of flexible watertight material;

providing the element with side walls which hang downward from the at least two straight edges; and arranging the rectangular strip of flexible watertight material on the side walls, along the corner, wherein a part of the strip extends above the upper surface of the element.

15. The method according to claim 13, wherein when arranging the element in the floor, the corner of the element with the downward folded strip is arranged at a distance from walls adjacent to the floor.

16. The method according to claim 13, wherein the angle is 90 degrees.

* * * * *